United States Patent [19]

Buscher

[11] Patent Number: 4,922,217

[45] Date of Patent: May 1, 1990

[54] TORQUE MOTOR WITH MAGNET ARMATURE

[75] Inventor: John H. Buscher, East Amherst, N.Y.

[73] Assignee: HSC Controls, Inc., Buffalo, N.Y.

[21] Appl. No.: 208,991

[22] Filed: Jun. 17, 1988

[51] Int. Cl.[5] ..... H01F 7/08

[52] U.S. Cl. ..... 335/229; 335/230; 335/279

[58] Field of Search ..... 335/229, 230, 272, 279; 310/29, 36; 251/129 J6

[56] References Cited

U.S. PATENT DOCUMENTS

| | | | |
|---|---|---|---|
| 2,915,681 | 12/1959 | Troy | 335/229 |
| 3,175,585 | 3/1965 | Faisandier | 137/625.65 |
| 3,330,301 | 7/1967 | Ludwig | 137/625.65 |
| 3,399,861 | 9/1968 | Howland | 251/129 |
| 3,531,745 | 9/1970 | Tibbetts | 335/231 |
| 3,803,522 | 4/1974 | Rooney | 335/231 |
| 4,142,166 | 2/1979 | Arnoux | 335/230 X |
| 4,325,043 | 4/1982 | Kimpel | 335/229 |
| 4,354,662 | 10/1982 | Thompson | 251/129 |
| 4,428,559 | 1/1984 | Ichiryu et al. | 251/129 |
| 4,464,978 | 8/1984 | Ichiryu et al. | 91/459 |
| 4,628,809 | 12/1986 | Das et al. | 100/208 |
| 4,631,430 | 12/1986 | Aubrecht | 310/12 |
| 4,641,072 | 2/1987 | Cummins | 318/687 |
| 4,804,934 | 2/1989 | Finke et al. | 335/229 |

FOREIGN PATENT DOCUMENTS

| | | | |
|---|---|---|---|
| 0225038 | 6/1987 | European Pat. Off. | 335/230 |
| 2197754 | 5/1988 | United Kingdom | 335/230 |

*Primary Examiner*—George Harris
*Attorney, Agent, or Firm*—Joseph P. Gastel

[57] ABSTRACT

A torque motor including a frame of soft magnetic material, such as soft iron, spaced first end portions on the frame, an armature which is a magnet, spaced second end portions on the armature, a mounting member for mounting the armature on the frame for allowing motion of the armature relative to the frame, each of the end portions of the armature including a north pole and a south pole, air gaps between the end portions of the frame and the end portions of the armature, a coil mounted on the frame, and the armature being in the form of a laminate with a central layer being a rare earth magnet between outer layers of magnetic material.

33 Claims, 5 Drawing Sheets

Fig. 10.
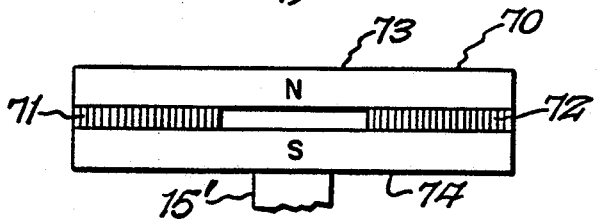
Fig. 11.
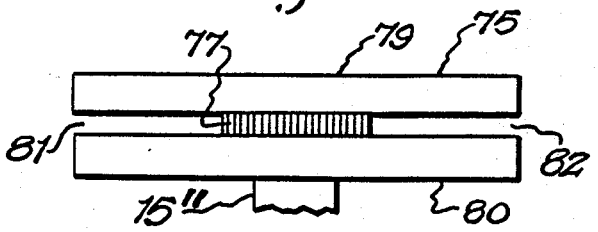
Fig. 12.
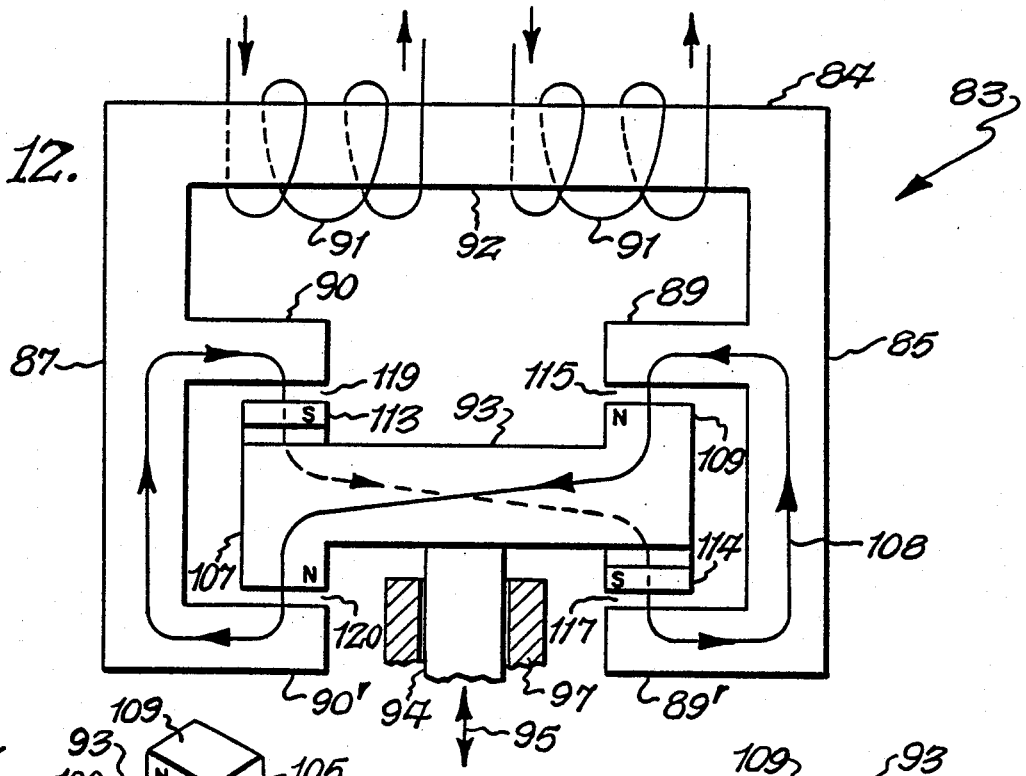
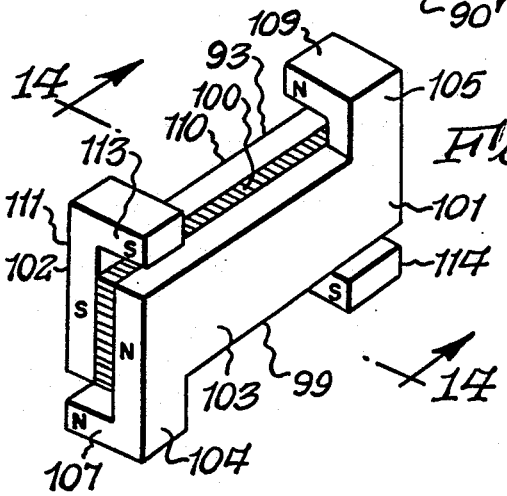
Fig. 13.
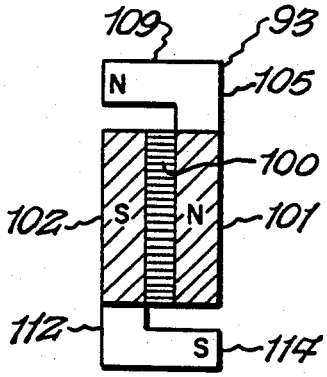
Fig. 14.
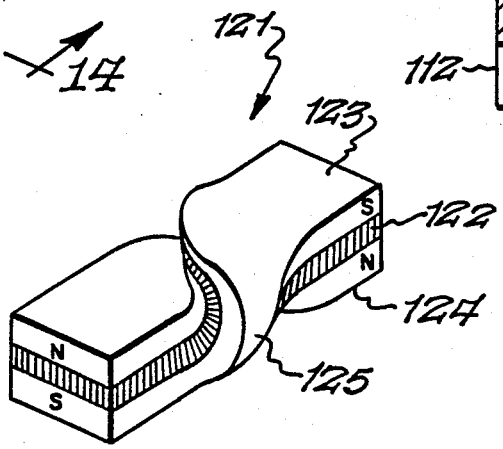
Fig. 15.

TORQUE MOTOR WITH MAGNET ARMATURE

BACKGROUND OF THE INVENTION

The present invention relates to an improved high performance torque motor which may have a relatively small size, and/or a relatively high torque, and/or large angular displacements when compared to conventional torque motors.

By way of background, designers of torque motors attempt to maximize torque and displacement output with minimum electrical input, size and weight. By way of further background, conventional torque motors include a frame, magnets mounted on the frame, an armature, and a coil wound around the armature, with the coil either being rigidly attached to the frame or mounted on the armature. In these motors there is limited space for the coil. Furthermore, where the armature is mounted on the frame, the size of the coil must be designed with clearance around the armature to allow for armature motion. Also, the area of the air gaps between the frame and the armature is limited by the size of the coil window, that is, the opening in the coil in which the central portion of the armature is located. Furthermore, torque motor performance is limited by the size and type of the permanent magnet. Additionally, there is a relatively great loss of magnetic flux because of leakage between the various parts and because of the various bends in the frame through which the magnetic lines of force from the magnets have to pass. In other words, losses are due to the fact that the magnets in a conventional torque motor are spaced relatively far from the air gaps. In addition, the greater the loss, the greater is the volume of coils and power required to compensate for the loss, which in turn increases the size of conventional torque motors for producing a given output.

SUMMARY OF THE INVENTION

It is accordingly one object of the present invention to provide an improved torque motor which provides large force-producing air gap areas between the armature and the frame to thus provide a relatively large magnetic force as compared to conventional torque motors because the air gap areas are not restricted by the size of the opening in the coil surrounding the armature.

Another object of the present invention is to provide an improved torque motor which is relatively small in size for the relatively large force which it produces and for the relatively large armature motion through which it is able to produce this force, as compared to conventional torque motors.

A further object of the present invention is to provide an improved torque motor which is rugged and simple in construction and which has less parts than conventional torque motors generally in use.

Yet another object of the present invention is to provide an improved torque motor in which flux losses are minimized, thereby providing a high efficiency as well as permitting the torque motor to be of a relatively small size for a given desired output.

Still another object of the present invention is to provide an improved torque motor with an unique sandwich armature incorporating a rare earth permanent magnet material which permits the use of relatively thin magnets of large cross sectional area in the motor. A related object is to provide an improved torque motor which, by utilizing the improved armature, permits the windings to be placed efficiently around the frame. Other objects and attendant advantages of the present invention will readily be perceived hereafter.

The present invention relates to a torque motor comprising a frame of magnetic material, an armature which is a permanent magnet, means for mounting said armature for movement relative to said frame, gap means between said armature and said frame, and coil means operatively associated with at least one of said frame and said armature.

The various aspects of the present invention will be more fully understood when the following portions of the specification are read in conjunction with the accompanying drawings wherein:

BRIEF DESCRIPTION OF THE DRAWINGS

FIGS. 10 and 11 are fragmentary side elevational views of modified armatures which can be used in the embodiment of FIGS. 1–9;

FIG. 12 is a schematic view of the type shown in FIG. 9 but depicting a linear torque motor;

FIG. 13 is a perspective view of the armature which is used in the embodiment of FIG. 12;

FIG. 14 is a cross sectional view taken substantially along line 14—14 of FIG. 13;

FIG. 15 is a perspective view of another species of armature which can be used in the linear torque motor of FIG. 12;

DESCRIPTION OF THE PREFERRED EMBODIMENTS

Figure 2:
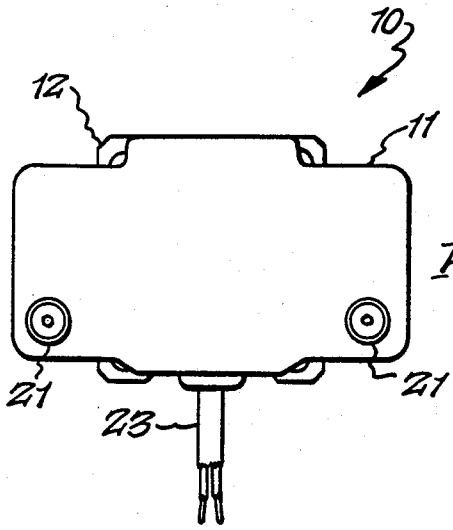
FIG. 2 is a top plan view of the servovalve of FIG. 1.
Figure 1:
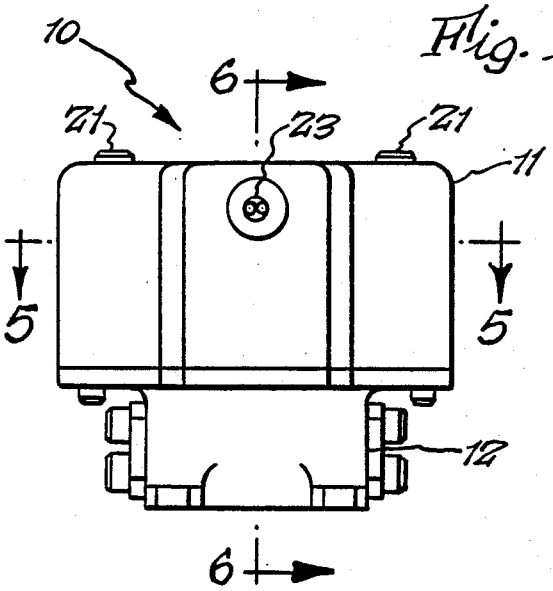
FIG. 1 is a side elevational view of a four-way flow control servovalve which includes a four gap torque motor which actuates its flow control spool directly.
Figure 4:
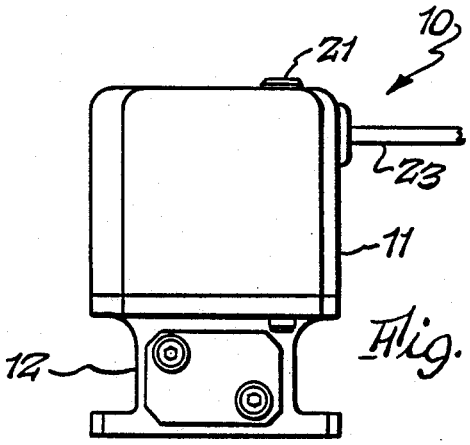
FIG. 4 is an end elevational view taken from the left of FIG. 1.
Figure 3:
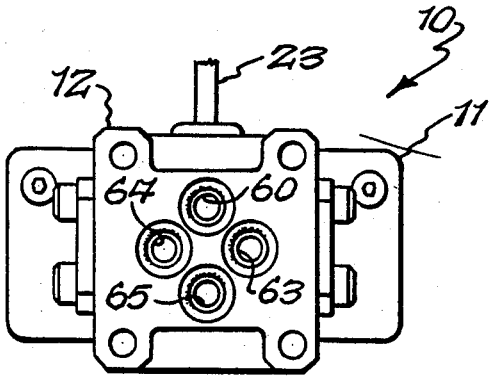
FIG. 3 is a bottom plan view of the servovalve of FIG. 1.

The improved servovalve 10 of FIGS. 1–8 includes a housing 11 which is mounted on a valve housing 12. A torque motor 13 is mounted within housing 11. A spool 14 is mounted within valve housing 12. The flapper 15 of torque motor 13 is connected directly to spool 14 to actuate it in response to electrical energization of torque motor 13.

In accordance with the present invention, the torque motor 13 includes a frame 16 of magnetic material and a laminated armature 17 which is coupled to flapper 15 to shift spool 14 back and forth in response to the electrical energization of motor 13. Frame 16 includes a central portion 26 which merges into spaced sides 19, one of which merges into a pair of spaced end portions 20 and 20', and the other of which merges into a pair of spaced end portions 18 and 18'. The frame is retained in position within housing 11 by screws 21 which bear on the top of frame 16 to clamp it between housing 11 and the top of valve housing 12. A pair of wire coils 22 encircle central portion 26 of the frame and are connected to a suitable source of electricity through cord 23.

A more specific description of frame 16 is that it is of broadly U-shaped configuration which includes a central or base portion 26 which merges into spaced sides 19 which extend perpendicularly thereto in the same plane and extend outwardly in both directions from opposite sides thereof, thus essentially being of H-shaped form to this point. A pair of spaced end portions 20 and 20' extend outwardly perpendicularly from the outer ends of one side 19, and a pair of spaced end portions 18 and 18' extend outwardly perpendicularly from the other side 19. Spaced parallel end portions 20 and 20' essentially lie in a first plane which is perpendicular to the plane of portion 26 and sides 19. Spaced parallel portions 18 and 18' lie in a second plane which is perpendicular to the plane of portion 26 and sides 19. The first and second planes are parallel to each other.

Figure 9:
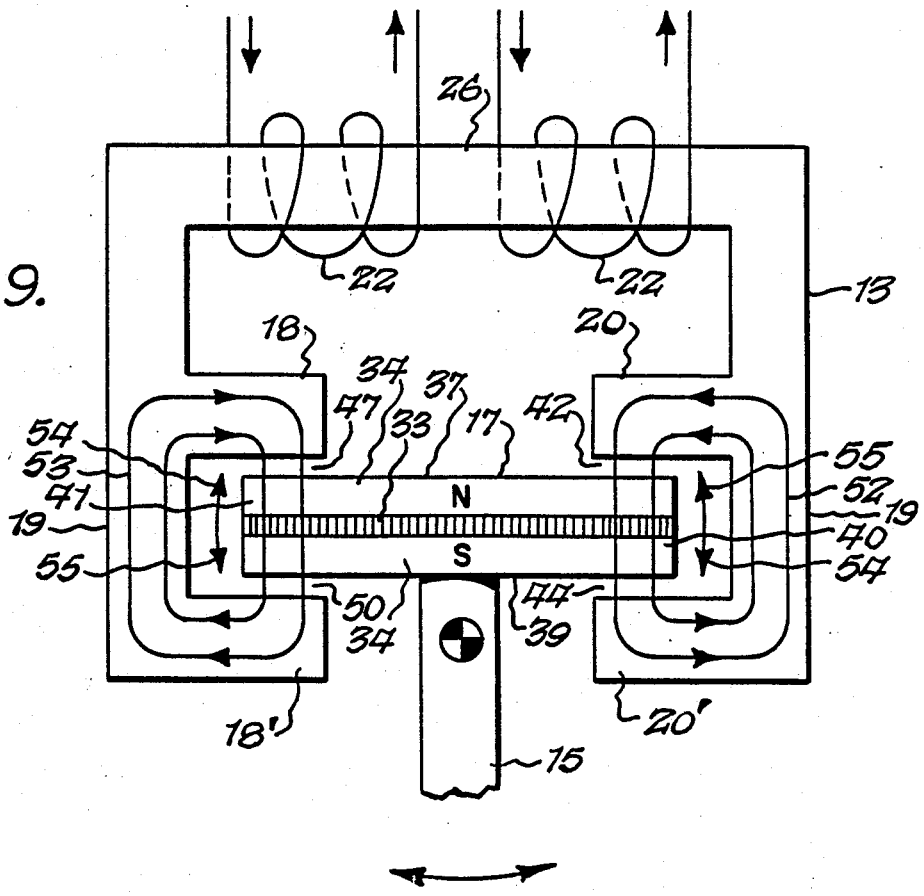
FIG. 9 is an enlarged fragmentary schematic view of the torque motor of the servovalve of FIGS. 1–8.

A simplified frame is schematically shown in FIG. 9 wherein it is essentially of U-shaped configuration with a base 26, legs 19 extending substantially perpendicularly thereto, a first pair spaced substantially parallel end portions 20-20' which extend inwardly into the opening of the U from one side or leg 19, and a second pair of substantially parallel end portions 18-18' which extend inwardly into the opening of the U from the other side or leg 19. The base 26 and end portions 18-18' and 20-20' are all substantially parallel to each other. It will be appreciated that the foregoing frame configurations are merely by way of example and not of limitation.

Elongated armature 17 has its central portion 24 suitably secured, as by brazing, to torsion spring 25, the opposite ends of which are bolted to valve housing 12 by means of screws 27. The top of flapper 15 is suitably secured, as by brazing, to the underside of torsion spring 25 at 29. Flapper 15 is located in bore 30 of valve housing 12 and its lower end 31 comprises a ball which is located with a suitable clearance in cross bore 32 (FIG. 8) in spool 14. Thus, it can be seen that the torque motor 13 drives spool 14 directly because of the connection between the armature 17, torsion spring 25 and flapper 15, which is essentially an elongated link connecting the torsion spring to the spool 14.

In accordance with one aspect of the present invention, armature 17 is a magnet while frame 16 is made of magnetic materials. In addition, in this embodiment, the coils 22 are wound around the frame rather than being wound around the armature 17, as in a general conventional torque motor. The magnet structure of the armature 17 is in the nature of a laminate having a rare earth magnetic central layer 33 and two outer layers 34 of magnetic material. The rare earth magnet 33 may be, without limitation, samarium cobalt or neodymium iron. The outer layers 34 may be, without limitation, 4750 nickel iron, ingot iron or permendur. The thickness of the rare earth layer 33 will determine the magnetomotive force. The critical feature is that the rare earth magnet layer 33 is oriented so that the lines of force travel in a vertical direction in FIG. 9. More specifically, the configuration of rare earth magnet layer 33 is such that its bottom is of one polarity, for example, south, and it top is of the opposite polarity, for example, north. Thus, the entire top surface 37 of armature 17 will be of one polarity and the entire opposite bottom surface 39 of armature 17 will be of the opposite polarity.

Armature 17 has opposite end portions 40 and 41 which lie between frame portions 20-20' and 18-18', respectively. An air gap 42 is located at armature end 40 between upper armature surface 37 and surface 43 of frame end portion 20. An air gap 44 is located at the armature end 40 between lower armature surface 39 and surface 45 of frame end portion 20'. An air gap 47 is located at armature end 41 between upper armature surface 37 and surface 49 of frame end portion 18. An air gap 50 is located at armature end portion 41 between lower armature surface 39 and surface 51 of frame end portion 18'. Thus, as depicted by numeral 52 (FIG. 9), a magnetic circuit is established through armature end portion 40, air gaps 42 and 44, frame portions 20 and 20', and frame portion 19. Also, a magnetic circuit 53 (FIG. 9) is established through armature end portion 41, air gaps 47 and 50, frame portions 18 and 18', and frame portion 19. Magnetic circuits 52 and 53 are polarizing fluxes produced by the permanent magnet in the armature. The magnetic circuits produced by the flow of current through coils 22 are not shown, and the interaction between these and the polarizing flux is also not shown as these are known to those skilled in the art. As will be appreciated, armature 17 may be caused to pivot in the direction of arrows 54 or 55 depending on the direction of current applied to coils 22. As can be seen from FIG. 9, the flux in the air gaps 42, 44, 47 and 50 extends substantially perpendicularly to the facing surfaces of the armature and the frame end portions on the opposite sides of each air gap. This relationship also is true for the embodiments of FIGS. 12 and 16 discussed hereafter. Also, the air gaps are essentially located in planes which intersect the directions of relative movement between the armature and frame. The same is true of the embodiment of FIG. 12.

The drive between torque motor 13 and valve 12 is direct. Thus, there need be no fluid flow to chambers 57 and 59 (FIG. 8) to shift spool 14. Thus, when spool 14 is in the position of FIG. 8, the fluid which enters conduits 61 and 62 from fluid inlet 60 connected to source P cannot pass beyond spool 14. When spool 14 is shifted to the left by torque motor 13, conduit 61 is placed in communication with conduit 63 and conduit 64 is placed in communication with return conduit 65 which is in communication with reservoir R. When spool 14 is shifted to the right, conduit 62 is placed in communication with conduit 64, and conduit 63 is placed in communication with return conduit 65. Conduits 64 and 63 are in communication with remote areas $C_1$ and $C_2$, respectively.

The direct coupling of the torque motor to provide proportional control of the four-way spool way thus eliminates the hydraulic amplifier (flapper-nozzle pilot stage) which is otherwise conventionally employed in certain hydraulic servo-valve structures. Furthermore, the foregoing structure provides greater power than conventional state-of-the-art torque motors which makes it manifestly suitable for the direct drive servovalve. In addition, since, as noted above, there is fluid flow through valve 12 only when spool 14 is actuated, the servovalve 10 is manifestly suitable for applications utilizing a limited source of fluid pressure. Also, the above-described structure of the torque motor permits it to fit into a relatively small envelope. Furthermore, the rare earth magnet of the armature is utilized highly efficiently because it provides large areas for relatively high magnetomotive force. In addition, the structure achieves a good performance/weight/space envelope ratio and is of simple economical and rugged design. As noted above, the thickness of the rare earth magnet determines the magnetomotive force. The structure of the above-described torque motor permits the frame 13 to be machined out of a single part, and the coils can be wound around the frame, thus eliminating the danger of loose coils commonly used o conventional type torque motors which have the coils wound around the armature. Furthermore, the above-described structure consists of only three basic parts, namely, the frame, the coil, and the armature. In contrast to this, conventional torque motors consist of four parts, namely, a frame, magnets mounted on the frame, an armature, and a coil. In addition, a torque motor, as described above, which does not have a coil around the armature can have relatively large air gap areas to provide relatively large magnetic forces, as compared to conventional torque motors, because there is no need for the armature width to be limited by the size of the opening in the coil because the coil is mounted on the frame remote from the armature, and not around the armature. It will be understood that each air gap area is the cross sectional area of the flux between the facing surfaces of the armature and frame end portions at each air gap.

In FIGS. 10 and 11 modified armatures are shown which can be used in the embodiment of FIGS. 1–9. Armature 70 includes two spaced rare earth magnets 71 and 72 which are sandwiched between soft iron layers 73 and 74, with the latter being mounted on a flapper 15' which is analogous to flapper 15 of the preceding figures. In FIG. 11, the armature 75 consists of a rare earth magnet 77 centrally located between soft magnetic material layers 79 and 80 with the latter being mounted on a flapper 15'' which is analogous to flapper 15 of FIGS. 1–9. The difference between armature 17 of FIGS. 1–9, on one hand, and the armatures of FIGS. 10 and 11, on the other hand, is that the permanent magnets of FIGS. 10 and 11 are shorter than the outer soft iron layers. By varying the length of the rare earth magnet, the amount of polarizing flux produced thereby can be adjusted. In other words, by reducing the cross sectional area of the rare earth magnets about a horizontal plane, the available flux is reduced. The ability to tailor the size of the permanent rare earth magnet or magnets in the foregoing manner aids in controlling the gain or adjusting the performance of the torque motor. Also, it is difficult to control the level of the magnetism during the fabrication of rare earth magnets, and this can be compensated for in any given armature by adjusting its size as depicted in FIGS. 10 and 11. In addition, by varying the size of the permanent rare earth magnet in the armatures of FIGS. 10 and 11, different parameters can be obtained in torque motors having frames and coils of standard sizes. In other words, with a given size frame with given size coils, the characteristics of a torque motor can be varied by varying the size of the permanent rare earth magnet in generally the manner shown in FIGS. 10 and 11, which are strictly by way of example and not by limitation. In addition to the foregoing, the embodiment of FIG. 11 has air gaps 81 and 82 at the outer ends thereof. This also contributes to the characteristic of the armature in that it reduces the useful flux by increasing the leakage within the armature, thereby also providing an arrangement for controlling the characteristics of the armature. Modifications of the armature, such as shown in FIGS. 10 and 11, can also be used in the armatures of FIGS. 12–15.

In FIG. 12, there is shown a schematic representation of a linear torque motor 83 which utilizes the armature 93 of FIGS. 13 and 14. This armature is essentially a sandwich containing a central layer which is a permanent rare earth magnet. More specifically, linear torque motor 83 includes a frame 84 having sides 85 and 87. Side 85 terminates at spaced frame end portions 89 and 89' and frame side 87 terminates at frame end portions 90 and 90'. The frame structure may be identical to that described above relative to FIGS. 1–9. Coils 91 are wound around frame portion 92 in a manner identical to that described above relative to FIGS. 1–9. An armature 93 (FIGS. 12–14) has its central portion mounted on shaft 94 which is guided for linear reciprocating motion in the direction of arrows 95 by bearing 97. Armature 93 includes a central portion 99. A central layer 100, which is a permanent rare earth magnet, is located between outer layers 101 and 102 of suitable magnetic material such as soft iron, 4750 nickel iron, ingot iron or permendur, as described above relative to the embodiment of FIGS. 1–9. Furthermore, the central layer may be modified as discussed relative to FIGS. 10 and 11. The rare earth magnet 100 is oriented with its polarity in a horizontal attitude as shown, that is, the lines of force extend horizontally in FIGS. 12 and 14. The outer layers 101 and 102 are broadly of S-shaped configuration. In this respect, outer layer 101 includes a central portion 103, outer side portions 104 and 105, which extend outwardly in opposite directions from the outer end portions of central portion 103 and lie in the same plane thereof, and substantially parallel portions 107 and 109 which extend perpendicularly in the same directions from the outer ends of portions 104 and 105, respectively, and lie in planes which are perpendicular to the other plane. Layer 102 includes a central portion 110, end portions 111 and 112, which extend in opposite directions from the outer end portions of central portion 110 and lie in the same plane thereof, and substantially parallel portions 113 and 114 extend perpendicularly in the same direction from the outer ends of portions 111 and 112, respectively, and lie in planes which are perpendicular to the other plane. Layers 101 and 102 can be of other shapes, the foregoing being merely by way of example. Essentially layers 101 and 102 are identical to each other except they are oriented in facing relationship. The polarity at the outer ends of the outer layers is as shown in FIG. 13, that is the outer ends of each layer is of the same polarity. Thus, the upper two outer ends of armature 99 are a north pole and a south pole, and the lower outer two ends of the armature are a south pole and a north pole which are opposite in polarity to the poles at the upper edge which are directly opposite to them. The solid and dotted line 108 with arrows thereon which passes through the armature and ends of the frame depicts the polarizing flux due to the permanent magnet in the armature 93. The magnetic circuits in the frame produced by the flow of current in coils 91 are not shown and the interaction between these and the polarizing flux is also not shown as these are readily understandable by those skilled in the art.

As can be seen from FIG. 12, there is an air gap 115 between armature portion 109 and frame end 89. There is an air gap 117 between armature portion 114 and frame end 89'. There is an air gap 119 between armature portion 113 and frame end 90. There is an air gap 120 between armature portion 107 and frame end 90'. When current is applied to coils 91, armature 93 will move in one of the directions of arrows 95 depending on the direction of current through coils 91. Shaft 94 may be attached to any desired type of item to provide motion thereto. For example, it may be attached to an end of a spool, such as 14 of FIGS. 1–9. In this event, the axis of the spool and the axis of shaft 94 would be in the same direction, whereas the flapper 15 of FIGS. 1–9 was perpendicular to the axis of spool 14. As described above relative to FIG. 9, the air gap flux is substantially perpendicular to the facing surfaces of the armature and end portions of the frame across the air gaps. The air gaps are located in planes which intersect the direction of relative movement between the armature and frame.

In FIG. 15 a laminated armature 121 is shown which is a modified embodiment of armature 93 of FIGS. 12–14. Armature 121 is layered with a central layer 122 which is a permanent rare earth magnet, and outer layers 123 and 124 are magnetic material, such as iron, or any of the other substances described above. Armature 121 is twisted 180° through its central portion at 125. Thus, the polarity is as shown wherein the upper surface of armature 121 has a north pole at one end and a south pole at the other end and the lower surface of armature 121 has a south pole at one end and a north pole at the other end. Poles of opposite polarity are thus located at each end of the armature. The armature 121 is intended to function in the same manner as discussed above relative to FIG. 12 to provide a linear torque motor.

Figure 16:
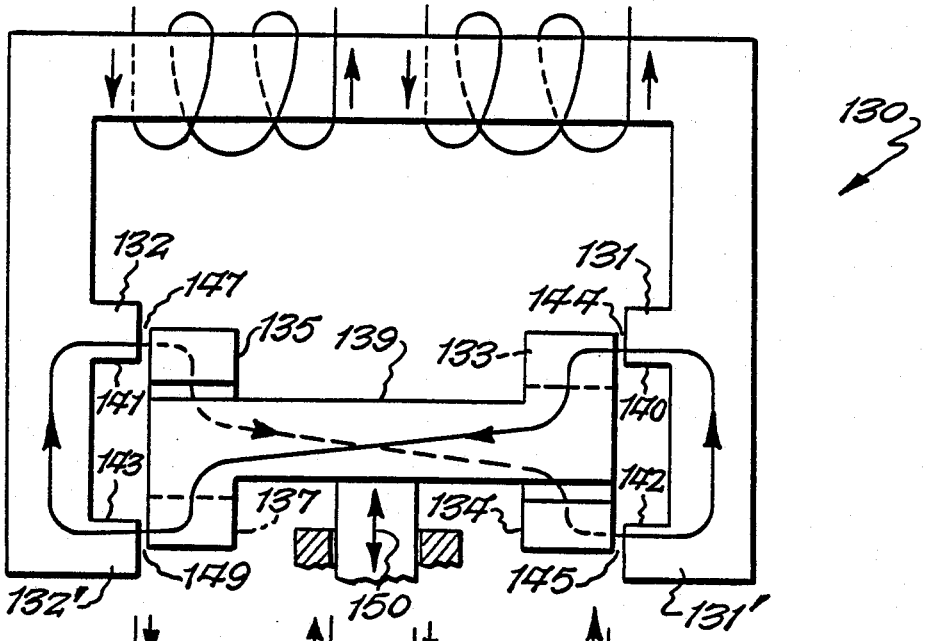
FIG. 16 is a schematic view of a torque motor similar to that shown in FIG. 12 but having the pole pieces oriented differently so that the motion of the armature is in a direction normal to the air gap flux.

In FIG. 16 a further modified embodiment of the present invention is disclosed. The torque motor 130 is identical in all respects to the torque motor 83 described above relative to FIG. 12 except in the placement of the frame end portions 131 and 131' and 132 and 132' and also in the dimensions of the portions 133, 134, 135 and 137 of the armature which are analogous to portions 109, 114, 113 and 107, respectively, of armature 93 of FIG. 12. Armature 139 functions in substantially the same manner as armature 93 of FIG. 12 and is of the same general shape. In its centered position, armature 139 is positioned so that the plane which extends through the undersides 140 and 141 of frame portions 131 and 132, respectively, bisects armature portions 133 and 135; and the plane which extends through sides 142 and 143 of frame portions 131' and 132', respectively, bisects armature portions 134 and 137. It will be appreciated that the dimensions can vary, but the preferred dimensions have been shown. The air gaps are designated by numerals 144, 145, 147 and 149. The linear motion of armature 139 is in the directions of arrows 150. It can readily be seen that this motion is substantially perpendicular to the air gap flux density in air gaps 144, 145, 147 and 149 because the air gap flux extends perpendicularly to the facing surfaces of the frame end portions and ends of the armature across the air gaps. Stated in another way the air gaps lie in planes which are substantially parallel to the direction of relative movement between the armature and frame. In other words, the motion of armature 139 when torque motor 130 is energized, will be in a direction substantially perpendicular to the lines of flux in the above-mentioned air gaps. This is in contrast to the embodiment of FIG. 12 wherein the direction of movement of the armature 93 is parallel to the lines of flux within the air gaps.

Figure 17:
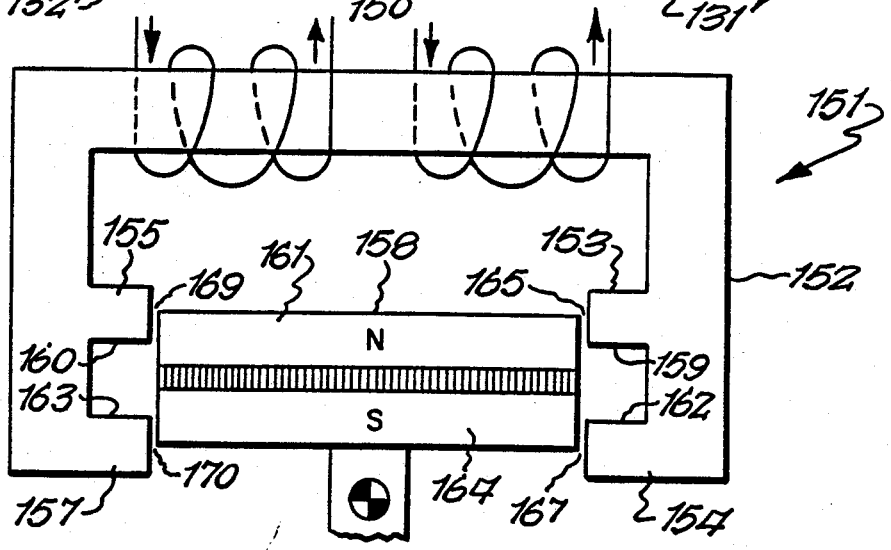
FIG. 17 is a schematic view of a torque motor similar to FIG. 9 but having the pole pieces oriented differently so that the motion of the armature is in a direction normal to the air gap flux.

In FIG. 17 a still further modified torque motor 151 is disclosed which is identical in all respects to the torque motor described above in FIG. 9 except for the configuration of the ends of frame 152 which are designated by numerals 153, 154, 155 and 157, and except for the dimensions of the armature. As in FIG. 16 noted above, these frame end portions are offset laterally from the ends of armature 159, whereas in FIG. 9 the corresponding frame portions bracket the ends of the armature. Preferably the undersides 159 and 160 of frame ends 153 and 155, respectively, lie in a plane which bisects the upper laminate layer 161; and the sides 162 and 163 of frame ends 154 and 157 preferably lie in a plane which bisects the lower laminate layer 164. However, the dimensions can vary. The air gap flux extends substantially perpendicular to the facing surfaces of the frame end portions and the armature across the air gaps. Stated otherwise, the air gaps lie in planes which are substantially parallel to the directions of relative movement between the armature and frame. The air gaps 165, 167, 169 and 170 are located so that the rotary motion of armature 159 is substantially perpendicular to the air gap flux density, or stated otherwise relative to the lines of the flux extending across the air gaps. This is in contrast to the embodiment of FIG. 9 wherein the direction of movement of the armature 93 is parallel to the lines of flux within the air gaps.

The advantages of the structures of FIGS. 16 and 17 wherein the direction of armature motion is substantially perpendicular to the air gap flux is that greater travel of the armatures can be obtained than in the embodiments of FIGS. 12 and 9. More specifically, a greater linear travel can be obtained in the embodiment of FIG. 16, and a greater rotary travel can be obtained in the embodiment of FIG. 17.

Relative to FIGS. 16 and 17, the structure thereof which was common to FIGS. 12 and 9, respectively, has not been described in the interest of brevity. However, it will be appreciated that such structure may be identical to that described above relative to these figures.

Figure 18:
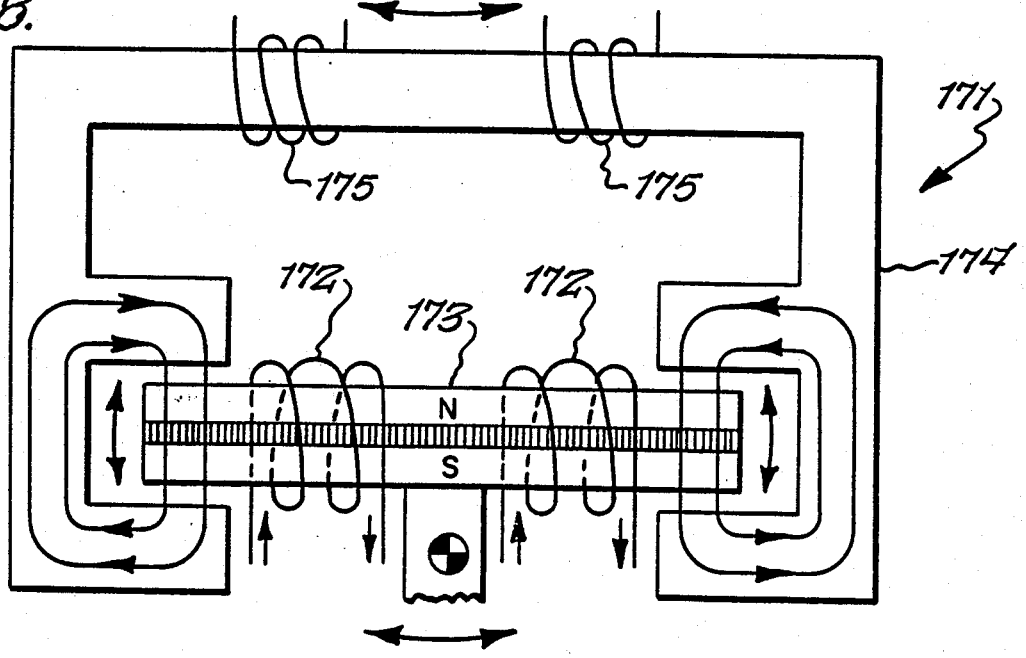
FIG. 18 is a schematic view of a modification which can be applied to any of the foregoing torque motors, the modification being that the coils are wound around the armature, or about both the armature and the frame.

In FIG. 18 a still further modified torque motor embodiment 171 is disclosed which is pictorially similar to that of FIG. 9 except that the coils 172, which are analogous to coils 22 of FIG. 9, are wound around the armature 173 rather than around the frame 174. It will be appreciated that in a structure of this type the coils are rigidly mounted on the frame of the torque motor as is conventional in the art. The same applies to FIG. 9 wherein the coils are mounted on the frame. It will be appreciated that the showing in FIG. 18 is strictly exemplary and is meant to represent that the coils, such as 172, may be wound around the armatures of any of the preceding embodiments rather than around the frames. Also if desired, the various torque motors can have coils wound around both the frame and the armature, and the latter is depicted by coils 175 in FIG. 18.

Figure 5:
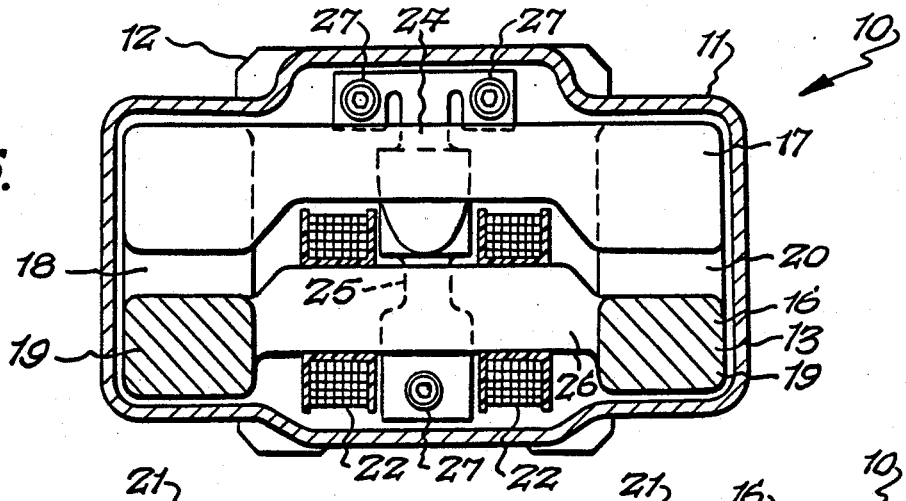
FIG. 5 is a cross sectional view taken substantially line 5—5 of FIG. 1.
Figure 7:
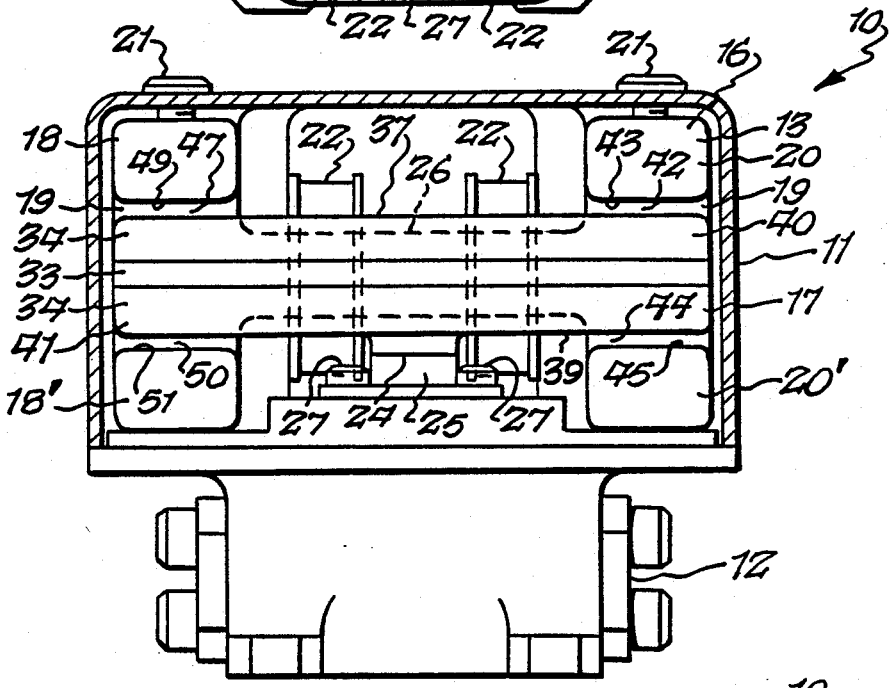
FIG. 7 is a cross sectional view taken substantially along line 7—7 of FIG. 6.
Figure 6:
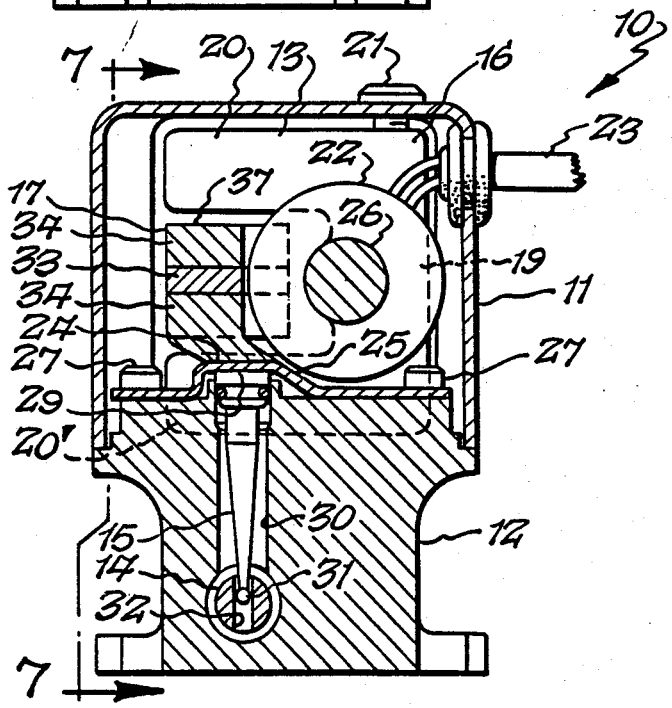
FIG. 6 is a cross sectional view taken substantially along line 6—6 of FIG. 1.
Figure 8:
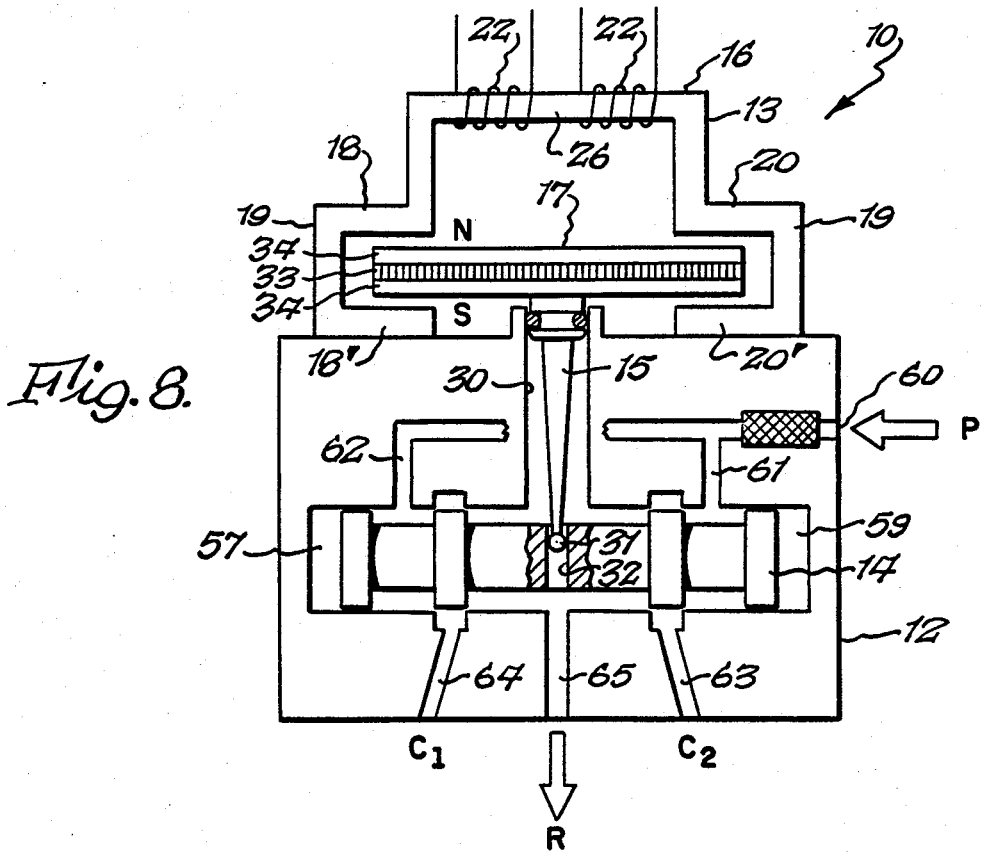
FIG. 8 is a schematic view of the servovalve of FIG. 1.

In all of the schematic figures, the mounting structure for the armatures has not been shown, but it will be understood that such mounting structures can be torsion springs, such as 25 of FIG. 5, for the rotary torque motors, and the mounting structure can include a spring arrangement in addition to the bearing structure for biasing the armature of the linear motors to a centered or neutral position when the torque motor is not energized. Furthermore, while all of the embodiments have been described gaps between the armature and frame as being air gaps, it will be appreciated that such gaps can contain any other non-magnetic fluids such as oil or water or other gases.

While preferred embodiments of the present invention have been disclosed, it will be appreciated that it is not limited thereto but may be otherwise embodied within the scope of the following claims.

What is claimed is:

1. A torque motor comprising a frame of magnetic material, spaced first end portions on said frame, an armature which is a laminate of a magnet with strips of magnetic material on both opposite sides of said magnet, spaced second end portions on said armature, mounting means for mounting said armature for movement relative to said frame, each of said second end portions including a north pole and a south pole, gap means between said first end portions of said frame and said second end portions of said armature, means for positioning said armature in a neutral position wherein said gap means exist between all parts of said first and second end portions, and coil means operatively associated with at least one of said frame and said armature for providing magnetic circuits for selectively positively moving said armature in opposite directions from said neutral position.

2. A torque motor as set forth in claim 1 wherein said coil is wound around said frame.

3. A torque motor as set forth in claim 1 wherein said coil is wound around said armature.

4. A torque motor as set forth in claim 1 wherein a first coil is wound around said frame and a second coil is wound around said armature.

5. A torque motor as set forth in claim 1 wherein said magnet comprises a rare earth magnet.

6. A torque motor as set forth in claim 1 wherein said armature has a first length and said magnet has a second length which is less than said first length.

7. A torque motor as set forth in claim 6 wherein said magnet comprises a rare earth magnet.

8. A torque motor as set forth in claim 5 wherein said coil is wound around said frame.

9. A torque motor as set forth in claim 5 wherein a first coil is wound around said frame and a second coil is wound around said armature.

10. A torque motor as set forth in claim 1 wherein said gap means comprise two gaps between each end portion of said armature and each end portion of said frame, and wherein one of said gaps at each end portion of said armature is between said north pole and said frame, and wherein the other of said gaps at each end portion of said armature is between said south pole and said frame.

11. A torque motor as set forth in claim 10 wherein said armature has two opposite sides, and wherein said north poles are on one side of said armature and said south poles are on the opposite side of said armature.

12. A torque motor as set forth in claim 1 wherein said mounting means comprises means for mounting said armature for rotary motion.

13. A torque motor as set forth in claim 1 wherein said mounting means comprises means for mounting said armature for linear motion.

14. A torque motor as set forth in claim 1 wherein said first and second end portions are oriented so that the direction of motion of said armature is substantially parallel to the flux therebetween.

15. A torque motor as set forth in claim 1 wherein said first and second end portions are oriented so that the direction of motion of said armature is substantially perpendicular to the flux therebetween.

16. A torque motor as set forth in claim 20 wherein said coil means is wound about said frame.

17. A torque motor as set forth in claim 20 wherein said coil means is wound about said armature.

18. A torque motor as set forth in claim 1 wherein each of said north and south poles at each of said second end portions on said armature are aligned substantially in the direction of said relative movement, and wherein said gap means are located in planes which intersect said directions of relative movement.

19. A torque motor as set forth in claim 1 wherein each of said north and south poles at each of said second end portions on said armature are aligned substantially in the direction of said relative movement, and wherein said gap means are located in planes which extend substantially parallel to said directions of movement.

20. A torque motor as set forth in claim 18 wherein said frame comprises an U-shaped structure having a base and legs extending outwardly therefrom, and wherein said spaced first end portions comprise a pair of spaced elongated ends extending outwardly from each of said legs with each of said elongated ends extending substantially perpendicularly to its respective leg and substantially parallel to and forming one side of each of its associated gap means.

21. A torque motor as set forth in claim 19 wherein said frame comprises an U-shaped structure having a base and legs extending outwardly therefrom, and wherein said spaced first end portions comprise a pair of spaced elongated ends extending outwardly from each of said legs with each of said elongated ends extending substantially perpendicularly to its respective leg and substantially perpendicularly to and forming one side of each of its associated gap means.

22. A torque motor comprising a frame of magnetic material, spaced first end portions on said frame, an armature which is a magnet, spaced second end portions on said armature, mounting means for mounting said armature for movement relative to said frame, each of said second end portions including a north pole and a south pole, gap means between said first end portions of said frame and said second end portions of said armature, coil means operatively associated with at least one of said frame and said armature, said armature having two opposite sides, said north poles being on opposite sides of said armature on opposite ends thereof, and said south poles being on opposite sides of said armature on opposite ends thereof.

23. A torque motor comprising a frame of magnetic material having a pair of spaced ends, spaced frame portions on each of said spaced ends of said frame, an armature which is a laminate of a magnet with strips of magnetic material on both opposite sides of said magnet, spaced end portions on said armature, mounting means for mounting said armature for movement relative to said frame, each of said spaced end portions including a north pole and a south pole, gap means between said spaced end portions of said frame and said spaced end portions of said armature, means for positioning said armature in a neutral position wherein said gap means exist between all parts of said spaced frame portions and said spaced end portions, and coil means operatively associated with at least one of said frame and said armature for providing magnetic circuits for selectively positively moving said armature in opposite directions from said neutral position.

24. A torque motor comprising a frame of magnetic material having a pair of spaced ends, spaced frame portions on each of said spaced ends of said frame, an armature which is a single elongated member containing a magnet with strips of magnetic material on both opposite sides of said magnet which causes said armature to be magnetic throughout its extent, spaced end portions on said armature, mounting means for mounting said armature for movement relative to said frame, each of said spaced end portions including a north pole and a south pole, gap means between said spaced end portions of said frame and said spaced end portions of said armature, and coil means operatively associated with at least one of said frame and said armature for selectively energizing said torque motor to effect movement of said armature relative to said spaced frame portions.

25. A torque motor as set forth in claim 24 wherein said strips of magnetic material on opposite sides of the armature are continuous throughout the extent of the armature.

26. A torque motor as set forth in claim 25 wherein said strips of magnetic material on both opposite sides of said magnet are substantially straight throughout the extent of said armature.

27. In a servovalve having a valve housing, a spool bore in said valve housing, a spool in said spool bore, and conduit means in said valve housing in communication with said spool bore, a torque motor comprising a frame, means securing said frame to said valve housing, spaced first end portions on said frame, an armature including a magnet and an elongated strip of magnetic material on each opposite side of said magnet with each of said strips being continuous throughout the length of said armature, spaced second end portions on said armature, each of said second end portions including a north pole and a south pole, gap means between said first end portions of said frame and said second end portions of said armature, a flapper coupled between said armature and said spool, and coil means operatively associated with at least one of said frame and said armature for selectively energizing said torque motor to effect movement of said armature to thereby cause said flapper to move said spool in said spool bore.

28. In a servovalve as set forth in claim 27 wherein said spaced first end portions each have spaced portions thereon, and wherein said gap means comprise a gap between each of said second ends of said armature and each of said spaced portions at each of said first end portions of said frame for a total of four gaps, and means for biasing said armature to a predetermined position to cause said spool engaged thereby to be biased to said predetermined position.

29. In a servovalve as set forth in claim 27 wherein said elongated strips of magnetic material are substantially straight throughout the extent of said armature.

30. In a servovalve having a valve housing, conduit means in said valve housing, and means for controlling the passage of fluid through said conduit means, a torque motor comprising a frame, means securing said frame to said valve housing, spaced first end portions on said frame, an armature including a magnet and an elongated strip of magnetic material on each opposite side of said magnet with each of said strips being continuous throughout the length of said armature, spaced second end portions on said armature, each of said second end portions including a north pole and a south pole, gap means between said first end portions of said frame and said second end portions of said armature, means coupled to said armature for being moved thereby, and coil means operatively associated with at least one of said frame and said armature for selectively energizing said torque motor to effect movement of said armature to thereby cause said last mentioned means to actuate said means for controlling the passage of fluid through said conduit means.

31. In a servovalve as set forth in claim 30 wherein said spaced first end portions each have spaced portions thereon, and wherein said gap means comprise a gap between each of said second ends of said armature and each of said spaced portions at each of said first end portions of said frame for a total of four gaps, and means for biasing said armature to a predetermined position to cause said means for controlling the passage of fluid through said housing to be biased to said predetermined position.

32. A torque motor as set forth in claim 24 wherein said frame comprises a generally U-shaped structure having a base and legs extending outwardly therefrom, and wherein said spaced ends are on said legs, and wherein said spaced frame portions on each of said spaced ends comprise a pair of spaced members extending transversely outwardly from each of said spaced ends, and each of said members forming one side of its associated gap means.

33. In a servovalve having a valve housing, conduit means in said valve housing, and means for controlling the passage of fluid through said conduit means, a torque motor comprising a frame, means securing said frame to said valve housing, spaced first end portions on said frame, an armature including a magnet and an elongated strip of magnetic material on each opposite side of said magnet with each of said strips being continuous throughout the length of said armature, spaced second end portions on said armature, each of said second end portions including a north pole and a south pole, gap means between said first end portions of said frame and said second end portions of said armature, means for positioning said armature in a predetermined position, means coupling said armature to said means for controlling the passage of fluid through said conduit means, and coil means operatively associated with at least one of said frame and said armature for energizing said torque motor to effect movement of said armature to thereby cause said last-mentioned means to provide proportional control of said means for controlling the passage of fluid through said conduit means.

* * * * *